United States Patent [19]

Schneller et al.

[11] Patent Number: 4,646,498

[45] **Date of Patent: * Mar. 3, 1987**

[54] CURTAIN WALL PANEL AND METHOD

[75] Inventors: Joseph W. Schneller, Williamsville; Donald A. Kossuth, Buffalo; J. Stephen Robinson, Williamsville, all of N.Y.

[73] Assignee: National Gypsum Company, Dallas, Tex.

[ * ] Notice: The portion of the term of this patent subsequent to Apr. 1, 2003 has been disclaimed.

[21] Appl. No.: 804,629

[22] Filed: Dec. 5, 1985

Related U.S. Application Data

[62] Division of Ser. No. 738,480, May 28, 1985, Pat. No. 4,590,733.

[51] Int. Cl.[4] ..... E04B 5/04

[52] U.S. Cl. ..... 52/309.12; 52/612

[58] Field of Search ..... 52/309.12, 612, 405, 52/309.17; 428/247, 319.1, 318.4, 192

[56] References Cited

U.S. PATENT DOCUMENTS

| | | | |
|---|---|---|---|
| 4,044,520 | 8/1977 | Barrows | 52/309.12 |
| 4,133,928 | 1/1979 | Riley et al. | 52/309.17 X |
| 4,186,536 | 2/1980 | Piazza | 52/309.12 |
| 4,349,398 | 9/1982 | Kearns et al. | 428/319.1 X |
| 4,578,915 | 4/1986 | Schneller | 52/309.12 |

*Primary Examiner*—Carl D. Friedman

*Attorney, Agent, or Firm*—Robert F. Hause

[57] ABSTRACT

A laminated curtain wall panel is prepared by continuously disposing foam boards onto adhesively coated gypsum sheathing followed by a third layer consisting of a reinforcing mesh and a cementitious binder, as the product progresses on a conveyor. The laminated product is erected by screws which are forced through the panel by a screw gun which disposes the screw head firmly against the gypsum sheathing.

6 Claims, 3 Drawing Figures

CURTAIN WALL PANEL AND METHOD

RELATED PATENT APPLICATION

This is a division of application Ser. No. 738480, filed May 28, 1985, now U.S. Pat. No. 4,590,783.

BACKGROUND OF THE INVENTION

Several board and panel products have been used or proposed for use in the construction of insulating curtain walls. U.S. Pat. No. 3,389,518 discloses constructing a curtain wall by adhering a plastic foam board layer to a supporting wall, adhering a reinforcing layer, consisting of a cementitious material and glass fabric, over the foam board layer, and finally applying a finish coating of a mixture of a mineral aggregate and a binder. A less labor intensive method would be advantageous, with respect to this prior method.

SUMMARY OF THE INVENTION

The present invention consists of a laminated panel, produced on a continuous conveyor, which includes a gypsum sheathing board, a plastic foam board and a third layer including reinforcing mesh and a cement binder.

The product is formed by continuously disposing plastic foam board on top of gypsum sheathing on which an adhesive material was continuously deposited, following which the third layer of a reinforcing mesh and a cementitious binder is continuously deposited on the foam board.

The laminated panels are erected to form the base for a curtain wall by affixing the panels to non-load-bearing metal studs. The panels are affixed to the studs either immediately prior to erecting the studs or after the studs are affixed in their normal spaced parallel vertical positions. The panels are affixed to the studs by self drilling, self tapping drywall screws which are forced through all layers of the panel and into the metal stud by a powered screw gun having a screw depth guide which stops the advance of the screw when the guide contacts the fabric reinforced layer of the panel, which is also when the screw head has finished passing through the foam board layer and is contacting and firmly holding the gypsum board layer against the metal stud.

It is an object of the present invention to provide a novel advantageous, laminated product for use in constructing building curtain walls.

It is a further object to provide a novel method for making laminated curtain wall panels.

It is a still further object to provide a novel method of affixing laminated curtain wall panels to building framing members.

BRIEF DESCRIPTION OF THE DRAWINGS

These and other objects and advantages will be more readily apparent when considered in relation to the preferred embodiments, as set forth in the specification, and shown in the drawings, in which.

DESCRIPTION OF THE PREFERRED EMBODIMENTS

Figure 2:
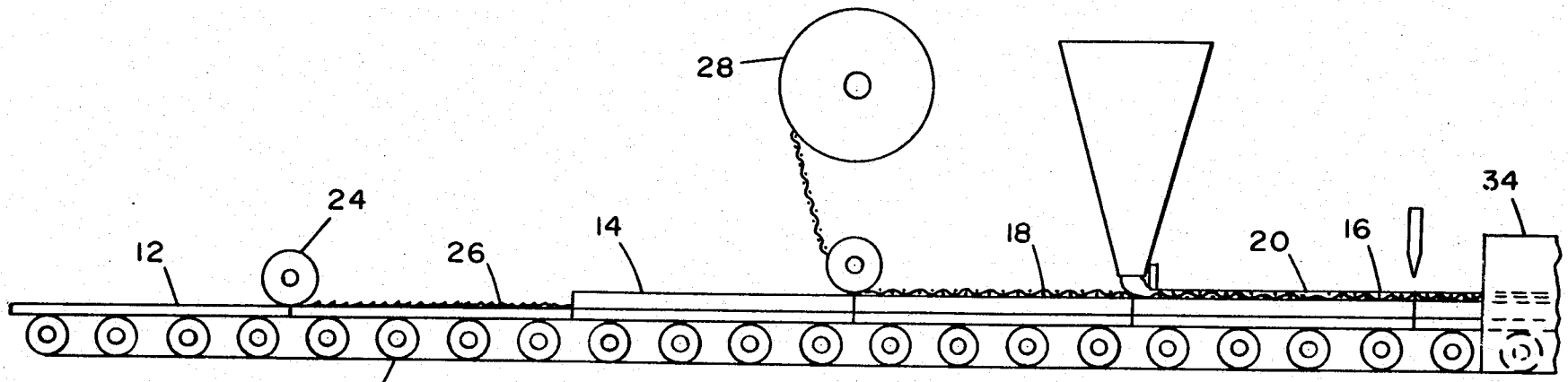
FIG. 2 is a diagrammatic side view of the apparatus and process for making the panel of FIG. 1.
Figure 1:
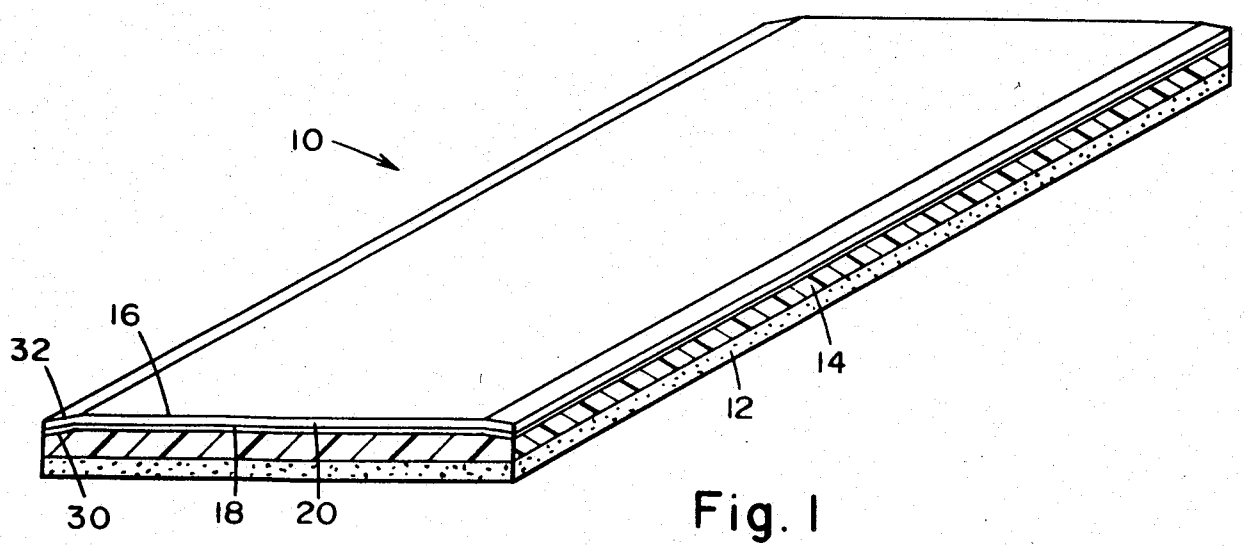
FIG. 1 is an isometric end view of the curtain wall panel of the present invention.

Referring to FIG. 1, there is shown a laminated panel 10 consisting of a gypsum sheathing board 12, a plastic foam insulation board 14, and a third layer 16 consisting of a web of fiber glass mesh 18 embedded in a latex-modified Portland cement mortar 20.

In the preferred embodiment, gypsum sheathing boards 12, typically $4' \times 8' \times \frac{1}{2}''$, are continuously laid on a conveyor 22, end to end, as the conveyor moves forward, passing the boards 12 under a roll coater 24 which applies a continuous coat 26 of polyvinyl alcohol adhesive onto the top face of the boards 12. Immediately following the application of the adhesive coat 26, plastic foam boards 14, typically $4' \times 8'$ polystyrene bead boards having a thickness of between about $\frac{1}{2}''$ to $3''$, are continuously alined with and laid on each gypsum board 12 adhered thereto.

As the conveyor continues to move forward with the laminated gypsum boards 12 and foam boards 14, a continuous web of fiber glass mesh 18 is fed from a roll 28 onto the upper face of the foam board 4 and disposed to cover the entire width of the foam board 14 and advance with the foam board 14 as they pass under a hopper of latex-modified Portland cement mortar 20.

The web of fiber glass mesh 18 is preferably an open mesh scrim having about 36 openings per square inch and a thickness of about 0.012 inch. Immediately after the fiber glass mesh 18 is laid on the top of the foam boards 14, a layer of mortar 20, about 0.016 inch thick, is deposited on the top of the foam boards 14, surrounding and embedding the mesh 18 within the mortar 20, bonding the mesh 18 to the top of the foam boards 14.

In the preferred form, the foam boards 14 have a shallow wide tapered edge 30 along each side, on the surface, to which the fiber glass mesh 18 and the mortar 20 conform, producing a similar tapered edge 32 on the mortar surface. The tapered edges 30 and 32 may have a width of about one and a half inches and a taper depth of about 3/32 inch.

The 0.016 inch thick layer of mortar 20 is made reasonably smooth by a light screeding which maintains the desired thickness of mortar across the width of the laminated panels 10 and improves the adhesion of the mortar to the form board 14. After forming the mortar and mesh third layer 16, the mesh 18 is cut at the abutting ends of foam boards 14, and the mortar 20 is also severed, forming the individual panels 10, with settable mortar 20 in the third layer 16.

The panels 10, with the settable mortar 20, are then conveyed through a drying oven 34 to partially dry the mortar and accelerate the setting of the mortar to an extent that makes the panels capable of being handled and removed from the conveyor.

The mortar composition is of a formula approximately as follows:

| | Pounds |
|---|---|
| Sand | 72 |
| Acrylic Latex Emulsion (50% solids) | 15 |
| Thickener | 0.5 |
| Defoamer | 0.25 |
| Ammonia | 0.1 |
| Preservative | 0.02 |
| Water | 13 |
| Type I Portland Cement | 100 |

The sand is a Martin Marietta Corporation 420 grade fine sand. The acrylic latex emulsion may be Rohm & Haas Co. latex E 330 or Rhoplex AC-64. The thickener is Rohm & Haas Co. Acrysol TT 615 acrylic acid thickener. The defoamer is Drew Chemical Corp. 483 L. The preservative is Merck & Co., Inc. Tektamer 38 AD.

Figure 3:
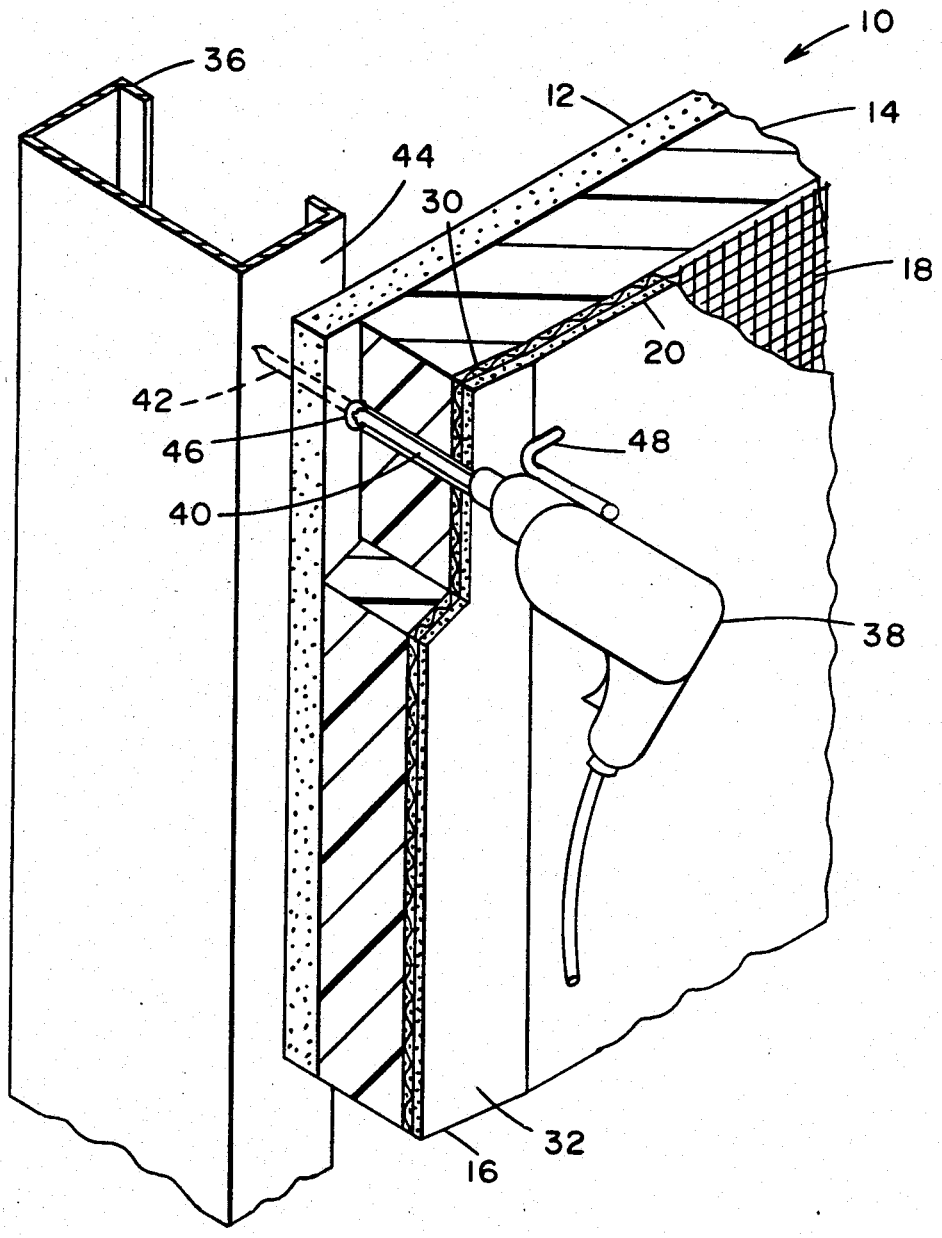
FIG. 3 is a cross sectional side view of the panel of FIG. 1 being affixed to a metal stud.

When the mortar 20 has reached substantially full set strength, the panels 10 may be shipped for use in constructing the curtain walls of building. It is contemplated that the panels 10 be screw attached to screwable sheet metal drywall studs 36, as shown in FIG. 3. The panels may be attached to the studs either just prior to erection of the studs, or at any time subsequent to the erection of the studs.

The panels 10 are affixed to the studs by a modified power operated screw gun 38, having a special elongated screw driver attachment 40. Attachment 40 has an end for receiving and holding screws 42. Attachment 40 is essentially a screw driver shaft having a diameter substantially equal to the diameter of the head of the screw 42 and a length equal to the total thickness of the foam board 14 and the third layer 16, whereby screw gun 38 is able to drive a screw completely through panel 10 and the abutting flange 44 of the screw stud 36, with the head 46 of the screw 42 engaging and holding the gypsum sheathing board 12, having passed completely through the foam board 14 and the third layer 16.

The attachment of panel 10 to the stud 16 is substantially stronger by having the screw head engaging the gypsum sheathing board layer, as opposed to having a longer screw with the screw head engaging the third layer. Heat transmission through the full thickness of the panel is avoided by using the shorter screws as compared to long screws engaging the third layer.

To make certain that the screw head firmly engages the gypsum sheathing board layer without penetrating through the surface of the gypsum board, a depth guide 48 is affixed to the special attachment 40. Depth guide 48 is mounted a fixed distance from the end of attachment 40 such that engagement of guide 48 against the surface of the third layer 16 occurs simultaneously with the screw head 46 engaging the gypsum sheathing board 12.

After the studs 36 are in their mounted vertical position and the panels 10 are all affixed thereto, the joints are covered with a reinforcement, prior to the application of a finish veneer stucco over the entire surface. The reinforcing includes a narrow tape of fiber glass leno weave mesh. Preferably the tape is one and a half inches wide, 0.008 inch thick and about 10×10 per inch mesh.

The tape is applied, centered over each joint, with a joint compound as follows:

| | Pounds |
|---|---|
| Ground Silica | 10 |
| Type I Portland Cement | 10 |
| Acrylic Latex Emulsion (50% solids) | 1 |
| Water | Sufficient to trowel |

The ground silica is #270 grade from Ottawa Industrial Sand Co.

When the joint concealing treatment is finished, a veneer stucco finish is applied over the mesh-mortar surface and the joint treatment surface. The finish material may be a mixture of latex and sand applied in a thickness of 1/32" (about ½ lb of wet material/ft$^2$) or a sand-latex-portland cement mixture.

The sand-latex mixture works well when applied in thin thicknesses, however if thicker coatings, for improved impact resistance, are required, the sand-latex-cement-mixture will allow application of thicker coatings ½–2 lb/ft$^2$ without check cracking the surface during the drying and setting stage.

An example of a sand-latex finish coat is as follows:

| | Pounds |
|---|---|
| Fine Sand | 450.0 |
| Coarse Sand | 150.0 |
| Acrylic Latex Emulsion (50% solids) | 230.0 |
| Thickener | 2.0 |
| Defoamer | 2.5 |
| Ammonia | 0.5 |
| Ethylene Glycol | 20.0 |
| Attapulgite Clay | 8.5 |
| Coalescent | 3.5 |
| Mildew Preventative | 3.0 |
| Dispersant | 0.25 |
| Wetting Agent | 0.25 |
| Water | 67.0 |
| Water added on-site | up to 10.0 |

Except for the on-site water, these ingredients may be factory mixed, packaged and stored, prior to use.

The coalescent is Eastman Chemical Products Inc. Texanol. The mildew preventative is Rohm & Haas Co. Super Ad-it Mildew-aid. The dispersant is R. T. Vanderbilt Co. Darvan aryl alkyl sulfonate. The wetting agent is Rohm & Haas Co. Triton CF 10.

An example of a sand-latex-cement finish coat is as follows:

| | Pounds |
|---|---|
| Fine Sand | 65.6 |
| Dry Latex | 2.15 |
| Defoamer | .40 |
| Methylcellulose | .10 |
| White Portland Cement | 28.0 |
| Hydrated Type S Lime | 3.75 |
| Water added on-site | 20.0 |

Except for the on-site water, these ingredients may be factory mixed, packaged and stored, prior to use.

The dry latex is Air Products & Chemicals Inc. RP 246 ethylene vinyl acetate. The methylcellulose is Henkel Corp. Culminol 20000 PFR.

Upon drying and hardening of the finish material, a completed exterior surface of a very permanent nature is produced, having good insulating properties and highly acceptable aesthetic properties.

Having completed a detailed disclosure of the preferred embodiment of our invention so that those skilled in the art may practice the same, we contemplate that variations may be made without departing from the essence of the invention or the scope of the appended claims.

We claim:

1. A prefabricated laminated curtain wall panel comprising three layers, the first layer being a sheathing board, the second layer being a plastic foam insulation board and the third layer being a latex-modified Portland cement layer of about 0.016 inch thickness within which there is embedded a web of fiber glass mesh of about 0.012 inch thickness.

2. A prefabricated laminated panel as defined in claim 1 wherein said sheathing board is a gypsum sheathing board of about ½ inch thickness, and said panel has a width and length of about four feet and eight feet, respectively.

3. A prefabricated laminated panel as defined in claim 1 wherein said sheathing board is a gypsum sheathing board of about ½ inch thickness which is adhesively bonded to polystyrene bead board having a thickness of about ½ inch to 3 inches.

4. A prefabricated laminated panel as defined in claim 1 wherein said insulation board has a taper formed along each side on the surface to which the third layer is adhered, and wherein said third layer has a substantially uniform thickness and conforms to the taper on said insulation board surface.

5. A prefabricated laminated panel as defined in claim 4 wherein said taper is about one and one-half inches wide and about 3/32 inch deep.

6. A prefabricated laminated panel as defined in claim 1 wherein said latex-modified Portland cement is formed from a slurry which comprises, by weight, about 100 parts of Portland cement, about 72 parts of fine sand and about 15 parts of an acrylic latex emulsion which is about 50% water.

* * * * *

UNITED STATES PATENT AND TRADEMARK OFFICE

CERTIFICATE OF CORRECTION

PATENT NO. : 4,646,498

DATED : March 3, 1987

INVENTOR(S) : JOSEPH W. SCHNELLER, ET AL.

It is certified that error appears in the above-identified patent and that said Letters Patent are hereby corrected as shown below:

Column 1, line 7: change "4,590,783" to ---4,590,733---.

Column 2, line 23: change "4" to ---14---.

Column 2, line 46: change "form" to ---foam---.

Signed and Sealed this

Twenty-fourth Day of May, 1988

*Attest:*

DONALD J. QUIGG

*Attesting Officer*

*Commissioner of Patents and Trademarks*